United States Patent [19]

Karliner et al.

[11] Patent Number: 4,717,074

[45] Date of Patent: Jan. 5, 1988

[54] ADJUSTABLE ORIFICE FOR A SPRAYER UNIT

[75] Inventors: Rudolph Karliner, Minnetonka, Minn.; Guido Zimmermann, Friedrichshafen, Fed. Rep. of Germany

[73] Assignee: Wagner Spray Tech Corporation, Minneapolis, Minn.

[21] Appl. No.: 736,539

[22] Filed: May 21, 1985

Related U.S. Application Data

[63] Continuation-in-part of Ser. No. 623,967, Jun. 25, 1984, abandoned.

[51] Int. Cl.[4] ..... B05B 1/28

[52] U.S. Cl. ..... 239/288; 239/394; 239/600; 29/157 C; 137/315; 138/45

[58] Field of Search ..... 239/391, 394, 581, 288, 239/288.3, 288.5, 600.DIG. 9; 215/363; 251/206, 207; 29/157 C, 157 R, 407, 434; 285/91, 330; 137/38 Z, 15, 315; 138/45; 403/397; 248/316.7

[56] References Cited

U.S. PATENT DOCUMENTS

| | | | |
|---|---|---|---|
| 464,335 | 12/1891 | Scott | 239/DIG. 9 X |
| 562,410 | 6/1896 | Moon | 251/206 X |
| 578,706 | 3/1897 | Adams . | |
| 1,093,907 | 4/1914 | Birnbaum . | |
| 1,852,862 | 4/1932 | Smelik et al. | 239/394 |
| 2,388,093 | 10/1945 | Smith | 239/394 |
| 2,790,680 | 4/1957 | Rosholt . | |
| 3,088,679 | 5/1963 | Ford | 239/318 |
| 3,112,885 | 12/1963 | Bell et al. | 239/394 |
| 3,188,009 | 6/1965 | Miscovich | 239/407 |
| 3,202,291 | 8/1965 | Root | 248/316.7 X |
| 3,516,611 | 6/1970 | Piggott | 239/391 |
| 3,556,411 | 1/1971 | Nord | 239/581 |
| 3,809,799 | 5/1974 | Taylor | 248/316.7 X |
| 4,036,438 | 7/1977 | Soderlind et al. | 239/288.5 |
| 4,111,368 | 9/1978 | Brehm | 215/363 |
| 4,141,504 | 2/1979 | Anderson | 239/394 |
| 4,165,836 | 8/1979 | Eull | 239/288 X |
| 4,192,462 | 3/1980 | Erickson | 239/288 |
| 4,221,334 | 9/1980 | Christopher | 239/394 |
| 4,303,201 | 12/1981 | Elkins et al. | 239/383 |

FOREIGN PATENT DOCUMENTS

| | | | |
|---|---|---|---|
| 873808 | 4/1942 | France | 239/394 |
| 1371366 | 7/1963 | France . | |
| 2320790 | 6/1976 | France . | |
| 2476506 | 8/1981 | France | 239/394 |
| 128693 | 4/1950 | Sweden | 239/394 |

OTHER PUBLICATIONS

Derwent Publications, week 025, Aug. 1, 1979, London, GB; & SU-A-442 693 (Vinogradov N.S. et al.)17-0-1-1977, *Abstract*.

*Primary Examiner*—Andres Kashnikow
*Assistant Examiner*—Kevin P. Weldon
*Attorney, Agent, or Firm*—Hill, Van Santen, Steadman & Simpson

[57] ABSTRACT

An assembly for providing a number of different size orifices for a sprayer unit, such as a hand-held paint sprayer, has an orifice plate with a number of orifices of different diameters radially disposed near a periphery of the plate. The plate has a centrally disposed pivot pin which is received in a complementary slot in the nozzle guard for the sprayer unit. The orifice plate has a like number of detents in the periphery thereof, and is held in place both within the slot and so as to align one of the orifices with the discharge nozzle for the sprayer unit, by a clip spring having angled free ends respectively received in detents on opposite sides of the orifice plate. Axial movement of the orifice plate is restrained by tightening the nozzle guard which is received by threads on the sprayer unit. When a different orifice size is desired, the nozzle guard is loosened, the orifice plate is rotated about the pivot pin to position the desired orifice in front of the discharge nozzle, and the nozzle guard is again tightened.

22 Claims, 7 Drawing Figures

ADJUSTABLE ORIFICE FOR A SPRAYER UNIT

This is a continuation-in-part of application Ser. No. 623,967, filed June 25, 1984, now abandoned.

BACKGROUND OF THE INVENTION

1. Field of the Invention

The present invention relates to an assembly for providing multiple orifices of different sizes for a sprayer unit, and in particular to such an assembly for use with a paint sprayer unit having a nozzle guard.

2. Description of the Prior Art

Liquid delivery units such as sprayers for atomizing and discharging a liquid have many applications requiring different discharge rates as well as different spray sizes, that is, the solid angle or cone which the spray assumes upon discharge from the unit. Such different spray characteristics are obtained by the use of different constructed nozzles, and in particular by the use of orifices or discharge openings of different sizes. In many known devices, the sprayer unit can accommodate only a single nozzle, and therefore a nozzle assortment of interchangeable nozzles of varying sizes are provided, with a means for removably mounting one nozzle from the assortment on the unit which is suitable for a particular application. Interchanging such nozzles can be time consuming and the possibility of misplacing one or more of the individual nozzles exists.

In an effort to avoid the use of separately attachable and removable nozzles, several known sprayer devices are provided with an indexable turrent assembly having a plurality of orifices which are movable into position adjacent a nozzle discharge opening by rotating the turret. Such assemblies are described in general for sprayer units, for example, in U.S. Pat. Nos. 3,516,611 and 2,388,093. Another such unit is shown for use with a hand-held sprayer unit in U.S. Pat. No. 3,112,885.

One problem in the construction of an assembly having multiple orifices for use with a sprayer unit, particularly a light weight hand-held unit, is that of providing a reliable axial seal which will permit the element of elements in which the multiple orifices are disposed to be easily rotated or otherwise displaced yet prevents the leakage of the fluid being discharged after a particular orifice size has been selected and moved into position. A further problem associated with such units is that of providing a reliable multiple orifice assembly which can be easily disassembled and reassembled for cleaning as needed and which can be economically manufactured consistent with manufacturing specifications and tolerances for the remainder of the hand-held unit.

SUMMARY OF THE INVENTION

It is an object of the present invention to provide an assembly for use with a liquid delivery apparatus, such as a hand-held paint sprayer, which provides multiple orifices selectable by a user for controlling the discharge of fluid from the unit.

It is a further object of the present invention to provide such an assembly which is easily assembled and disassembled for cleaning as needed.

Another object of the present invention is to provide such an assembly for use in combination with a nozzle guard surrounding the discharge nozzle of a sprayer unit.

Another object of the present invention is to provide such an assembly which can be economically manufactured and integrated in the assembly process for the unit without significantly adding to the cost of the unit.

The above objects are inventively achieved in a multiple orifice assembly for a sprayer unit having an orifice plate with a plurality of differently sized orifices therein radially disposed near a periphery of the plate. The plate has a centrally disposed pivot pin which is received in a complementary slot in the sprayer. The orifice plate is held in the slot by a semicircular clip spring having angled free ends which are respectively received in opposite detents of the orifice plate. The orifice plate is otherwise unrestrained within the slot. The clip spring thus functions for simultaneously retaining the orifice plate in its mounting slot, and for positioning a selected orifice in front of a nozzle discharge opening or openings. Axial sealing of the assembly is achieved by tightening the nozzle guard, such as by threads, on the sprayer unit. When tightened, the entire assembly is axially press fit with no gaps permitting leakage. When a different orifice size is to be selected, the nozzle guard is backed off, or unthreaded, so as to loosen the axial seal, and the orifice plate is rotated to one of a plurality of positions defined by the detents, and is restrained in the selected position by the clip spring. After positioning a new orifice in front of the nozzle discharge, the nozzle guard is again tightened to achieve the axial seal.

DESCRIPTION OF THE PREFERRED EMBODIMENTS

Figure 1:
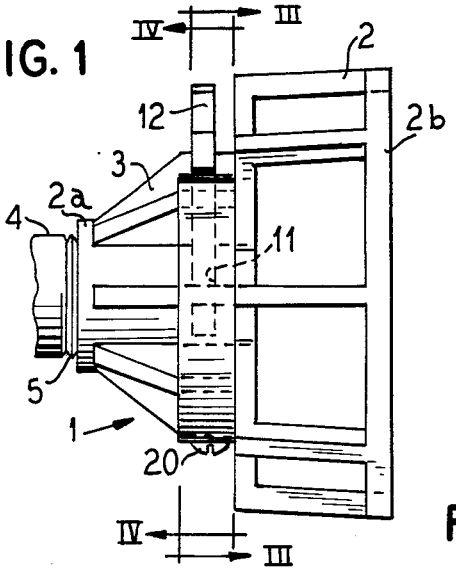
FIG. 1 is a side view of an adjustable orifice assembly constructed in accordance with the principles of the present invention.

An adjustable orifice assembly is shown in side view in FIG. 1 constructed in accordance with the principles of the present invention. The assembly 1 has a nozzle guard having a central portion 2*a*, a plurality of generally axially extending outer ribs 2 joined at their extreme ends by a circular rim 2*b*, an a plurality of radially extending inner support ribs 3. The central section 2*a* of the nozzle guard is received on the body 4 of a sprayer unit, not shown in greater detail. The body 4 has threads 5 which receive interior threads 5*a* of the central portion 2*a*.

The sprayer unit, a portion of which is indicated by the body 4, may be of the general construction and operation described, for example in U.S. Pat. No. 3,899,134, and the nozzle guard and nozzle construction may be of the type generally described, for example, in U.S. Pat. No. 4,036,438.

The body 4 carries a nozzle 6 received and seated in a nozzle chamber 7. The nozzle 6 may be of any suitable construction known to those skilled in the art and may have a single centrally disposed fluid discharge opening or may have a plurality of closely disposed openings, such as openings arranged at the corners of a triangle. The rear of the nozzle 6 is supported by a threaded nozzle mount 8 received in the body 4 having an interior channel 9. The nozzle 6 is biased within the nozzle chamber 7 by a coil spring 10.

Figure 5:
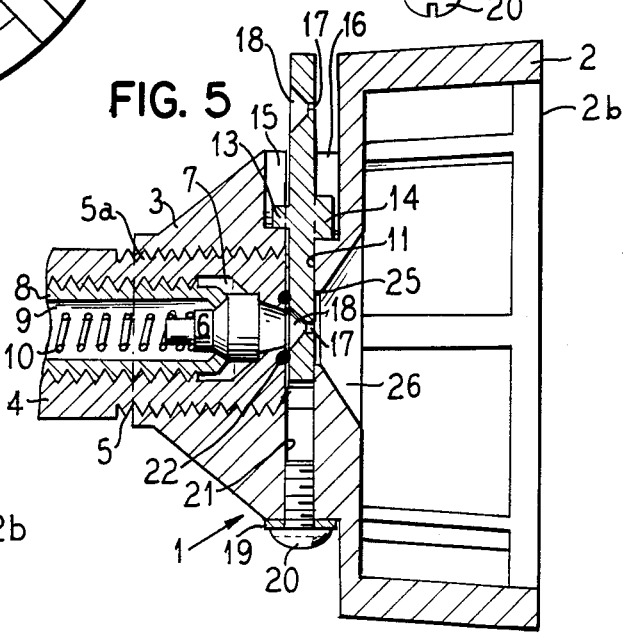
FIG. 5 is a sectional view of the assembly shown in FIG. 3 taken along line V—V.

The nozzle guard has a side to side slot 11 in which an orifice plate 12 is received. The orifice plate 12 has a centrally disposed pivot pin 13 of a first diameter on one side thereof, and another centrally disposed pivot pin 14 of a second diameter on the opposite side thereof. The centers of the pivot pins 13 and 14 are in axial coincidence. In the embodiment shown in the drawings, as best seen in FIG. 5, the diameter of the pin 13 is smaller than the diameter of the pin 14. The pin 13 is loosely received in a radial slot 15 in the nozzle guard and the pin 14 is similarly loosely received in a radial slot 16 in the nozzle guard on the opposite side of the plate 12. The slots 15 and 16 have respective widths which are complementary to the pins 13 and 14, so that the plate 12 can be positioned only one way within the slot 11.

The orifice plate 12 has a plurality of orifices 17 of different sizes on one side thereof facing away from the nozzle 6. Each orifice 17 has a conical inlet 18 positioned on the side of the plate 12 closer to the nozzle 6. The differently sized pins 13 and 14 insure that the plate 12 can only be placed within the slot 11 such that the inlets 18 are adjacent the nozzle 6. An O-ring seal 22 surrounding the nozzle 6 provides an axial seal when the nozzle guard is tightened on the body 4, as described in greater detail below. The nozzle guard also has an aperture 25 and an outlet cone 26 disposed in axial registry with the nozzle 6 and the orifice 17 positioned in front of the nozzle 6.

Figure 4A:
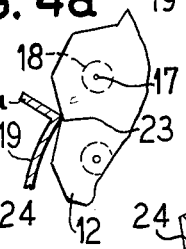
FIG. 4*a* is a partial view of the structure shown in FIG. 4 showing another embodiment for the retainer clip.
Figure 4:
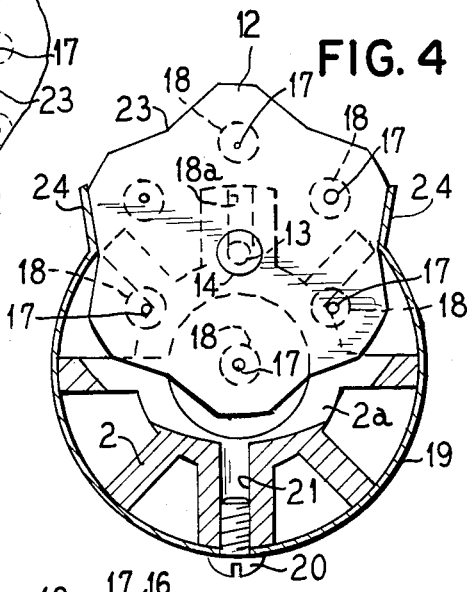
FIG. 4 is a view, partly in section, of the assembly shown in FIG. 1 taken along line IV—IV.

The orifice plate 12 is rotatable about the pivot pins 13 and 14 so as to position an orifice 17 of selected size in front of the nozzle 6. The orifice plate 12 may have visual indications thereon (not shown) positioned adjacent the respective orifices 17 to indicate the orifice size or index to a user. The orifice plate 12 has a plurality of detents 23 disposed between each of the different orifices 17. In the embodiment shown in the drawings, the plate 12 has an even number of such detents 23, so that when an orifice 17 is positioned in front of the nozzle 6, there will be a pair of oppositely disposed detents 23 associated with that position of the plate 12. The opposite detents 23 respectively receive free ends 24 of a semicircular spring clip 19, which is also received in the slot 11 of the nozzle guard. The clip spring 19 is restrained from radial movement by a fastening means 20, such as a screw, received in a bore 21 in the nozzle guard. As shown in FIG. 4, the flanged free ends 24 of the clip 19 are adjacent and in substantially complete contact with an edge of the orifice plate 12. A further embodiment is shown in partial view in FIG. 4*a*, wherein the flanged end 24*a* makes a substantially greater angle with the semicircular portion of the clip 19, and only the angle between the flange 24*a* and the semicircular portion is in contact with the detent 23.

Figure 2:
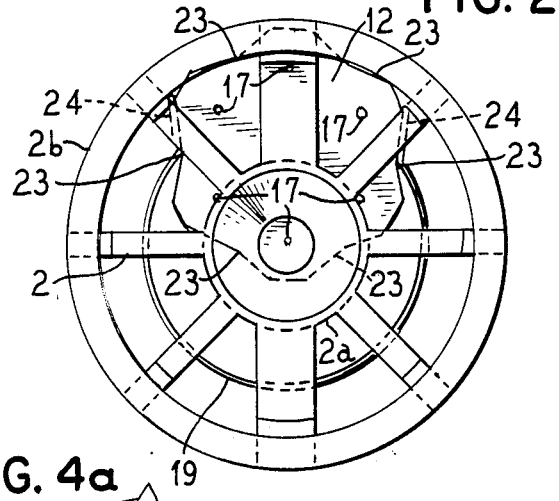
FIG. 2 is a front view of the assembly shown in FIG. 1.
Figure 3:
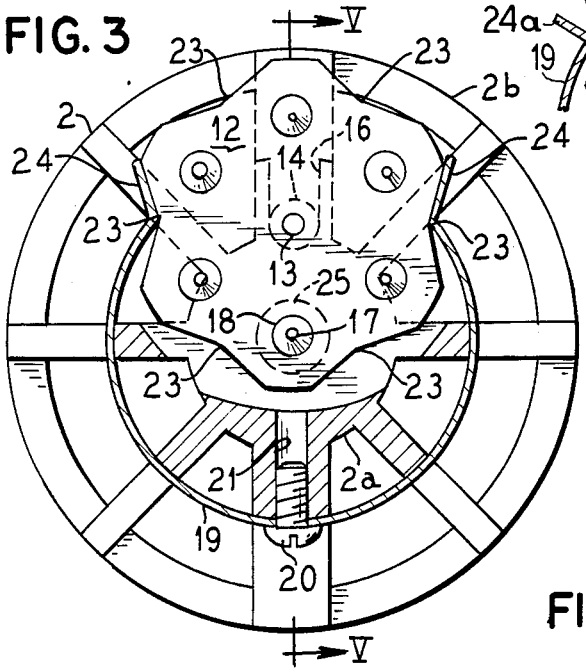
FIG. 3 is a view, partly in section, of the assembly shown in FIG. 1 taken along line III—III.

As stated above, an axial seal is provided by the O-ring 22 seated in the body 4 surrounding the nozzle 6. The term "axial" as used herein means the direction of fluid discharge through and from the nozzle 6, which is generally horizontal in the views shown in FIG. 1 and FIG. 5, and is a direction extending out of the plane of the paper for the views shown in FIGS. 2 through 4. As used herein, "lateral" means generally perpendicular to "axial." When repositioning of the orifice plate 12 is desired to bring a different size orifice 17 into position in front of the nozzle 6, the nozzle guard is backed off, or unthreaded, from the body 4, such as by gripping the outer ribs 2 and rotating the entire nozzle guard. This loosens the axial seal provided by the O-ring 22 and permits rotation of the orifice plate 12 about the pivot pins 13 and 14. The tension provided by the free ends 24 of the spring clip 19 permits the plate 12 to be positioned with stability only at those locations which cause one of the orifices 17 to be directly in front of the nozzle 6. After the selected orifice 17 has been positioned in front of the nozzle 6, the nozzle guard is again tightened on the body 4, again effecting an axial seal with the O-ring 22.

Figure 6:
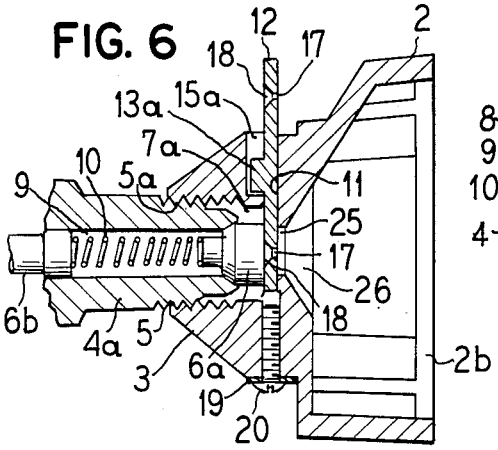
FIG. 6 is a sectional view of a further embodiment of the assembly constructed in accordance with the principles of the present invention along the same section as FIG. 5.

A further embodiment is shown in sectional view in FIG. 6, wherein elements common to FIG. 5 have been identified with the same reference symbols and modified versions of those elements have been identified with the reference symbol "a". As shown in FIG. 6, the body 4*a* has a larger chamber 7*a* in which a forward portion 6*a* of the nozzle is received. The chamber 7*a* is open and is completely covered at its open end by the orifice plate 12. The forward portion 6*a* of the nozzle is urged by the spring 10 tightly against the orifice plate 12 when the nozzle guard 2 is tightened on the body 4*a* by means of engaging threads 5 and 5*a*. In this embodiment, the nozzle has a rear portion 6*b* which is held in the body 4*a* and serves as a rear stop for the spring 10. Sealing is accomplished solely by a tight fit of all components, so that the O-ring 22 in the embodiment of FIG. 5 is not needed. The embodiment of FIG. 6 further differs from the earlier-described embodiment in that the orifice plate 12 has a single pin 13*a* on one side thereof, which is received in a corresponding radial slot 15*a* in one of the ribs 3. Since the pins 13*a* is disposed only on one side of the orifice plate 12, this insures that the orifice plate 12 can be placed in the unit in only one position, with the proper orientation of the conical inlets 18 adjacent the forward portion 6*a* of the nozzle.

Although modifications and changes may be suggested by those skilled in the art it is the intention of the inventors to embody within the patent warranted hereon all changes and modifications as reasonably and properly come within the scope of their contribution to the art.

We claim as our invention:

1. An adjustable orifice assembly for use with a liquid sprayer unit having a nozzle for discharging liquid in an axial direction, said assembly comprising:

a nozzle guard and means for tightening said nozzle guard on said sprayer unit surrounding said nozzle, said nozzle guard having a first slot extending radially through said nozzle guard and a second slot extending radially in said nozzle guard disposed on one side of said first slot;

an orifice plate disposed in said first slot and having a plurality of differently sized orifices therein radially disposed near a periphery of said orifice plate, said orifice plate further having a centrally disposed pivot pin received in said second slot of said nozzle guard for permitting rotation of said orifice plate thereabout to a selected one of a plurality of positions for aligning one of said orifices in front of said nozzle, said pivot pin and said second slot being disposed such that a portion of said periphery of said orifice plate is at all times exposed for access by a user of said liquid sprayer to rotate said orifice plate;

a retainer means connected to said nozzle guard and engaging said orifice plate for holding said orifice plate in said selected position; and a seal means for providing an axial seal between said sprayer unit and said orifice plate when said nozzle guard is tightened on said sprayer unit.

2. An adjustable orifice assembly as claimed in claim 1 further comprising:

a third slot extending radially in said nozzle guard disposed on a side of said first slot opposite said second slot; and a second centrally disposed pivot pin received in said third slot.

3. An adjustable orifice assembly as claimed in claim 2 wherein said pivot pin and said second pivot pin are of different diameters, and wherein said second slot and said third slot are of different sizes for respectively accommodating said different diameters, such that said orifice plate is always disposed in said first slot with a same side thereof adjacent said nozzle.

4. An adjustable orifice assembly as claimed in claim 3 wherein said orifice plate has a plurality of orifice inlets respectively disposed in registry with said orifices on said same side of said orifice plate.

5. An adjustable orifice assembly as claimed in claim 1 wherein said means for tightening said nozzle guard on said sprayer unit are threads on said sprayer unit and complementary engaging threads on said nozzle guard.

6. An adjustable orifice assembly as claimed in claim 1 wherein said retaining means permits stepped rotation of said orifice plate about said pivot pin.

7. An adjustable orifice assembly as claimed in claim 1 wherein said orifice plate has a plurality of detents carried on said periphery thereof, and wherein said retainer means engages at least one of said detents for holding said orifice plate in said selected position.

8. An adjustable orifice assembly as claimed in claim 7 wherein said detents are disposed in opposed pairs and wherein said retainer means simultaneously engages one of said opposed pairs of detents for holding said orifice plate in said selected position.

9. An adjustable orifice assembly as claimed in claim 8 wherein said retainer means is a semicircular clip spring having free ends respectively received in said detents in said pair of detents.

10. An adjustable orifice assembly for use with a liquid sprayer unit having a nozzle for discharging liquid in an axial direction, said assembly comprising:

a nozzle guard threadably received on said sprayer unit for permitting tightening of said nozzle guard on said sprayer unit surrounding said nozzle, said nozzle guard having a radial slot therein and having first and second mounting slots disposed on opposite sides of said radial slot;

an orifice plate disposed in said radial slot and having a plurality of differently sized orifices therein radially disposed near a periphery of said orifice plate, said orifice plate further having first and second centrally disposed pivot pins disposed on opposite sides thereof respectively received in said first and second slots in said nozzle guard for permitting rotation of said orifice plate about said pivot pins to a selected position for aligning one of said orifices in front of said nozzle, said orifice plate further having a plurality of detents in said periphery respectively associated with a selected position of said orifice plate said first and second mounting slots and said first and second pivot pins being disposed with respect to said nozzle guard for at all times exposing a portion of said periphery of said orifice plate for access by a user of said unit to rotate said orifice plate;

a spring clip retainer connected to said nozzle guard having free ends received in said detents for holding said orifice plate in said selected position; and a seal means for providing an axial seal between said sprayer unit and said orifice plate when said nozzle guard is tightened on said sprayer unit.

11. An adjustable orifice assembly as claimed in claim 10 wherein said seal means is an O-ring carried on said sprayer unit surrounding said nozzle.

12. An adjustable orifice assembly as claimed in claim 10 further comprising a plurality of orifice inlets respectively disposed in registry with said orifices in said orifice plate on one side of said orifice plate adjacent said sprayer unit.

13. An adjustable orifice assembly as claimed in claim 1 wherein said seal means is an O-ring carried on said sprayer unit surrounding said nozzle.

14. An adjustable orifice assembly as claimed in claim 1 wherein said seal means is a spring urging said nozzle against said orifice plate in sealing contact therewith.

15. An adjustable orifice assembly as claimed in claim 9 wherein said free ends of said clip are straight flanges disposed at an angle with respect to said semicircular spring clip.

16. An adjustable orifice assembly as claimed in claim 15 wherein said free ends are adjacent said orifice plate.

17. An adjustable orifice assembly as claimed in claim 15 wherein said free ends are spaced from said orifice plate such that said clip retains said orifice plate only along lines defined by said angle.

18. An adjustable orifice assembly as claimed in claim 10 wherein said seal means is a spring urging said nozzle against said orifice plate in sealing contact therewith.

19. An adjustable orifice assembly as claimed in claim 10 wherein said free ends of said clip are straight flanges disposed at an angle with respect to said semicircular spring clip.

20. An adjustable orifice assembly as claimed in claim 10 wherein said free ends are adjacent said orifice plate.

21. An adjustable orifice assembly as claimed in claim 10 wherein said free ends are spaced from said orifice plate such that said clip retains said orifice plate only along lines defined by said angle.

22. An adjustable orifice assembly for use with a liquid sprayer unit having a nozzle for discharging liquid in an axial direction, said assembly comprising:

a nozzle guard and a means for tightening said nozzle guard on said sprayer unit surrounding said nozzle and having a radial slot therein and a mounting slot extending adjacent to said radial slot and open thereto;

an orifice plate disposed in said radial slot in said nozzle guard and having a plurality of differently sized orifices therein radially disposed near a periphery of said orifice plate, a plurality of peripheral detents respectively associated with said different sized orifices, and an axially extending centrally disposed pin on one side thereof, said pin being received in said mounting slot in said nozzle guard permitting rotation of said pin and said orifice plate in said respective mounting and radial slots to a selected position, said slots disposed for aligning said orifices of said orifice plate in front of said nozzle as said orifice plate is rotated, said pin and said mounting slot being disposed with respect to said nozzle guard and said means for tightening said nozzle guard such that all times a portion of said orifice plate is exposed for access by a user of said unit to rotate said orifice plate;

a retainer clip having a semicircular portion connected to said nozzle guard and having free flanged ends angled from said semicircular portion, said clip engaging two of said detents of said orifice plate at the angle between said semicircular portion and end of said flanged ends for holding said orifice plate in said selected position in said nozzle guard; and a spring loading said nozzle in sealing contact against said orifice plate when said nozzle guard is tightened on said sprayer unit for preventing radial escape of liquid during operation of said sprayer unit.

* * * * *